United States Patent [19]

Buckner et al.

[11] Patent Number: 4,474,520

[45] Date of Patent: Oct. 2, 1984

[54] PIPE HANDLING MACHINE

[75] Inventors: James E. Buckner, Lafayette, La.; Earl C. McGuire, Centerville, Miss.

[73] Assignee: Ingram Corporation, New Orleans, La.

[21] Appl. No.: 353,925

[22] Filed: Mar. 2, 1982

[51] Int. Cl.[3] ..... E21B 19/14

[52] U.S. Cl. ..... 414/22; 187/12; 187/26; 414/639; 414/648; 414/748

[58] Field of Search ..... 414/22, 504, 595, 505, 414/598, 639, 648, 652, 745, 747, 748; 175/52, 85; 211/60 S; 187/10, 12, 26; 198/313, 632

[56] References Cited

U.S. PATENT DOCUMENTS

| | | | |
|---|---|---|---|
| 2,592,324 | 4/1952 | Oliver | 414/648 X |
| 2,643,006 | 6/1953 | King | 414/22 |
| 2,735,558 | 2/1956 | Chesher | 187/10 X |
| 3,273,734 | 9/1966 | Schuler | 414/504 |
| 3,774,780 | 11/1973 | Buffington | 414/745 X |
| 3,810,553 | 5/1974 | Crocker et al. | 414/22 |
| 3,835,940 | 9/1974 | Winter | 175/85 |
| 4,067,453 | 1/1978 | Moller | 414/22 |
| 4,235,566 | 11/1980 | Beeman et al. | 414/22 |
| 4,371,302 | 2/1983 | Frias et al. | 414/22 |
| 4,386,883 | 6/1983 | Hogan et al. | 414/748 X |

*Primary Examiner*—Leslie J. Paperner

*Attorney, Agent, or Firm*—Lalos, Leeds, Keegan, Lett, Marsh, Bentzen & Kaye

[57] ABSTRACT

An apparatus for transferring pipe between pipe racks and the drilling rig floor including a stationary trough located below and extending towards the drilling rig and a movable, inclined trough aligned with the stationary trough having one end supported on the drilling floor and the other end powered to move between a lower position for transferring pipe to and from the stationary trough and an upper position for transferring pipe to and from the drilling floor. Two pair of racking legs extending between the pipe racks and the fixed trough are provided. Each leg has a cradling lug which moves up and down the leg powered by a hydraulic cylinder, thereby lifting the pipe along the leg. Further, each leg is able to pivot in two directions about a pivoting structure. The pipe when moving in the troughs is held at one end by a shovel member which is engageable by the buggy traveling along the stationary trough and is also engageable by the carriage in the inclined trough. Two pair of wishbone shaped dumping arms are positioned beneath the fixed trough at a location adjacent the racking arms. These arms powered by fluid actuated cylinders pivot about a point on the stationary trough so that their outer end extends through openings in the stationary trough thereby engaging a pipe and moving the pipe out of the stationary trough to the racking arms. An operator's station is pivotally mounted on top of the stationary trough.

27 Claims, 23 Drawing Figures

PIPE HANDLING MACHINE

BACKGROUND OF THE INVENTION

This invention relates to a machine for handling pipe and similar tubular goods between a drilling rig and a pipe rack. It relates more particularly to a pipe handling machine adapted for use at onshore locations as well as to a machine that can be easily disassembled, transported between drilling rig sites, and reassembled at the new site.

In the prior art there are various methods and devices for lifting and moving pipe to and from pipe racks and an elevated drilling rig floor. One of such methods simply attaches a wire cable to the pipe and then the cable is lifted by a hydraulic winch which is typically mounted on the truck parked near the rig. Cranes and hydraulic driven chains have also been used to lift and move the pipe. These methods have proven to be very slow and thus very costly. They also have required additional personnel to handle the pipe at both the drilling rig site and at the pipe rack. As the pipe was transferred it could become unattached from the pipe lifting structure or more commonly could swing about thereby injuring personnel, or damaging the pipe or adjacent structure.

More recently machines have been built which have reduced these problems. However, these machines have also proven to be slow and cumbersome, as well as proven to be unsafe.

Machines have been built in the past which included a fixed trough, devices for moving pipe from the pipe rack to that trough, a moving means for moving the pipe from the fixed trough to a movable trough, and means for removing the pipe from the movable trough to the drilling rig floor. But, as has been previously discussed, these machines have proven to be cumbersome and slow.

Additionally, a pair of pipe racking arms positioned on either side of the stationary trough have been used. A length of chain is reeved about appropriate sprockets connecting pipe cradling lugs on legs on opposing sides of the stationary trough. A similar chain and lug assembly was provided on the other opposing pair of arms. A heavy and expensive motor and a large, single shaft drive apparatus were employed to turn the sprockets. Thus, as the shaft turned, both the cradling lugs on one side of the stationary trough would be moving upwardly while the opposing lugs on the other side of the trough would be moving in a downward direction. This often proved to be unnecessary and unsafe since only the arms of one side of the trough or the other were being used at any one time.

To move the pipe from the stationary trough to the racking arms a dump trough system has been used. This system employed a tiltable segment of trough tilted by two pair of hydraulic cylinders positioned at either ends thereof. This system proved to be very fragile because the pivot point for the dump trough portion was at one end of the hydraulic cylinder, and because the hydraulic cylinders had to lift an entire trough section as well as the pipe.

The operator's station in prior machines was a separate unit connected by appropriate control lines. This unit was difficult to lift onto a transporting vehicle when being moved between drilling rig sites and would have to be lifted separately from the troughs.

Another problem present in prior art machines was that no suitable method had been developed for moving the pipe between the fixed trough and the inclined trough and then from the inclined trough to the drilling rig floor. Some past devices even required personnel to be positioned adjacent to the movable trough to hook the pipe to suitable lifting means. This, of course, proved to be slow, costly and dangerous. Mechanical devices used to move the pipe were slow and often mechanically complicated. They also would bang the pipe about damaging the pin ends thereof or the pipe handling apparatus's drive chains.

OBJECTS OF THE INVENTION

Accordingly, it is the principal object of the present invention to provide an improved machine for transferring pipe between a pipe rack and the floor of a drilling rig, and conversely during other sequences in the drilling operation to transfer pipe from the drilling floor to the pipe rack.

Another object of the present invention is to provide a pipe handling machine which can be readily moved to and from a flatbed truck and the catwalk without requiring a crane or similar hoisting machinery.

A further object of the present invention is to provide a pipe handling machine which does not require that the pipe racking arms on both sides be extended when only one is in use.

A still further object of the present invention is to provide a pipe handling machine which allows the pipe racking arms to be easily pivoted to a position adjacent and parallel the stationary trough for easier transport of the machine.

Another object is to provide a pipe handling machine that has an operator's station attached thereto which can be folded down against the pipe handling machine for easier transport.

A further object is to provide a pipe handling machine which can transfer pipe from the pipe racks to the drilling rig with a short cycle time.

A still further object is to provide a pipe handling machine which brings the pipe end close to the center of the drilling rig and at a working level low enough to enable the pipe to be more accessible.

Another object is to provide a pipe handling machine which has an improved pipe tilting system for moving the pipe from a fixed trough to the pipe racking arms.

A further object is to provide a pipe handling machine having an improved pipe tilting system pivoting about a fixed point on the stationary trough.

A further object is to provide a pipe handling machine which smoothly moves the pipe along and between a horizontal fixed trough and an interesecting inclined trough to the drilling floor without damage to the pipe.

Other objects and advantages of the present invention will become more apparent to those persons having ordinary skill in the art to which the present invention pertains from the foregoing description taken in conjunction with the accompanying drawings.

THE DRAWINGS

DESCRIPTION OF THE INVENTION

General Description

Figure 1:
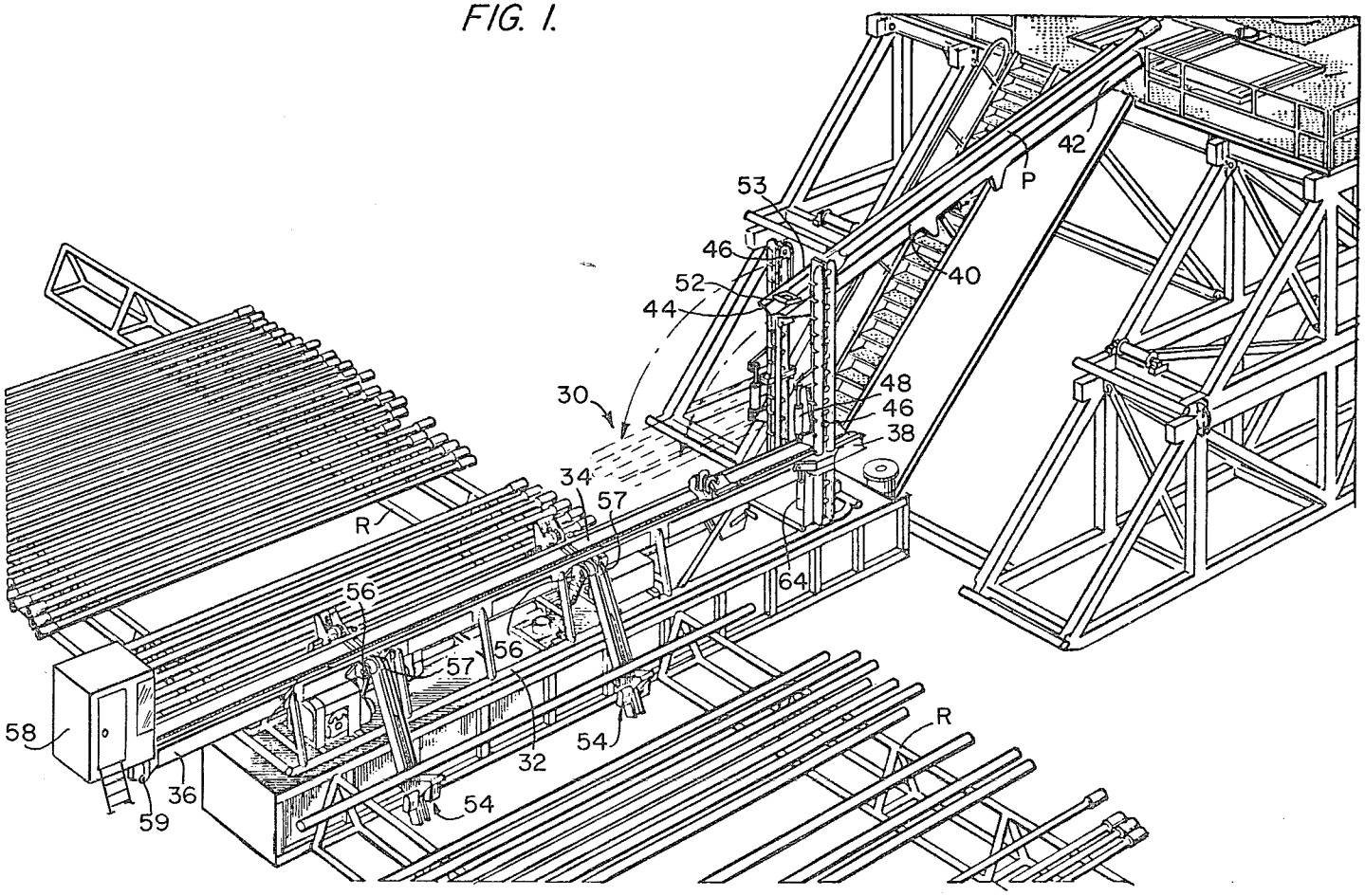
FIG. 1 is a perspective view of an apparatus embodying the present invention in use at a drilling rig site.

Referring to FIG. 1, there is illustrated an apparatus of an embodiment of the present invention shown generally at 30 for handling pipe P and other tubulars. This apparatus generally includes a main support frame 32 shown positioned on a catwalk C, a stationary trough 34 having ends 36 and 38 resting on and supported by support frame 32, and a movable trough 40 supported at one end 42 on drilling rig D and at its other end 44 by a pair of masts 46, 46. Masts 46, 46 are mounted on opposite sides of stationary trough end 38. A mast drive system shown generally at 48 lifts and lowers movable trough end 44 between masts 46, 46. As movable trough end 44 is raised to its upper position, movable trough end 42 is caused to slide further on to drilling rig floor D and to be positioned generally lower relative to drilling rig floor D whereby a length of pipe may be more easily removed from movable trough 40. When movable trough end 44 is in its lower position, movable trough 40 and stationary trough 36 are adjacent each other and are in alignment so that pipe can slide between them.

The present invention also provides for a buggy 50 which is powered to ride in stationary trough 34 between ends 36 and 38 thereof. Buggy 50 engages a shovel member 52 which is adapted to hold one end of a length of pipe P. Shovel member 52 is also engageable with a carriage or similar means 53 positioned in movable trough 40. Carriage 53 is similarly powered to move along movable trough 40 between ends 42 and 44 thereof. Carriage 53 is likewise engageable with shovel member 52 whereby pipe P held by shovel member 52 may be moved between stationary trough 34 and drilling rig floor D along movable trough 40. When movable trough end 44 is in its lower position, shovel member 52 holding pipe P may be moved between the two troughs.

The present invention also includes a racking arm assembly shown generally at 54 for moving pipe between pipe racks R, R and stationary trough 32. Pipe racks R, R are positioned on either side of stationary trough 32 and are illustrated in FIG. 1 as comprising triangular shaped structures though any suitable racks may be used. Racking assembly 54 is positionable on one or both sides of stationary trough 34, as will be described in greater detail later. Also, a tilting arm assembly shown generally at 56 is provided. This assembly 56 moves the pipe between stationary trough 34 and racking arm assembly shown generally at 54. Each of these racking arms is provided with a pivotal attachment 57 allowing pivotal movement in two directions so that the arms can be positioned alongside the stationary trough for easier transport of apparatus 30 and when not the particular arm is not being used.

Thus, as is readily apparent, pipe can be moved by apparatus 30 between pipe racks R, R and drilling rig floor D in one smooth operation. Pipe on drilling rig floor D is positioned in movable trough 40 and held therein by shovel member 52, which is then moved down movable trough 40 by carriage 53 as movable trough end 44 is moved down between masts 46, 46 by mast drive system 48 to stationary trough end 38. When movable trough end 44 is in its lower position shovel member 52 is disengaged from carriage 53 and engaged to buggy 50. Thus, as buggy 50 is moved in stationary trough 34 towards end 36, pipe P travels therewith until it reaches a position over tilting arm assembly 56. Tilting arm assembly 56 is then tilted toward racking arm assembly 54, as will be described in greater detail later. At that point, the pipe is moved by the racking arm assembly downward until it rests on pipe rack R. A similar procedure in reverse is used to move the pipe from pipe racks R, R to drilling rig floor D.

Figure 3:
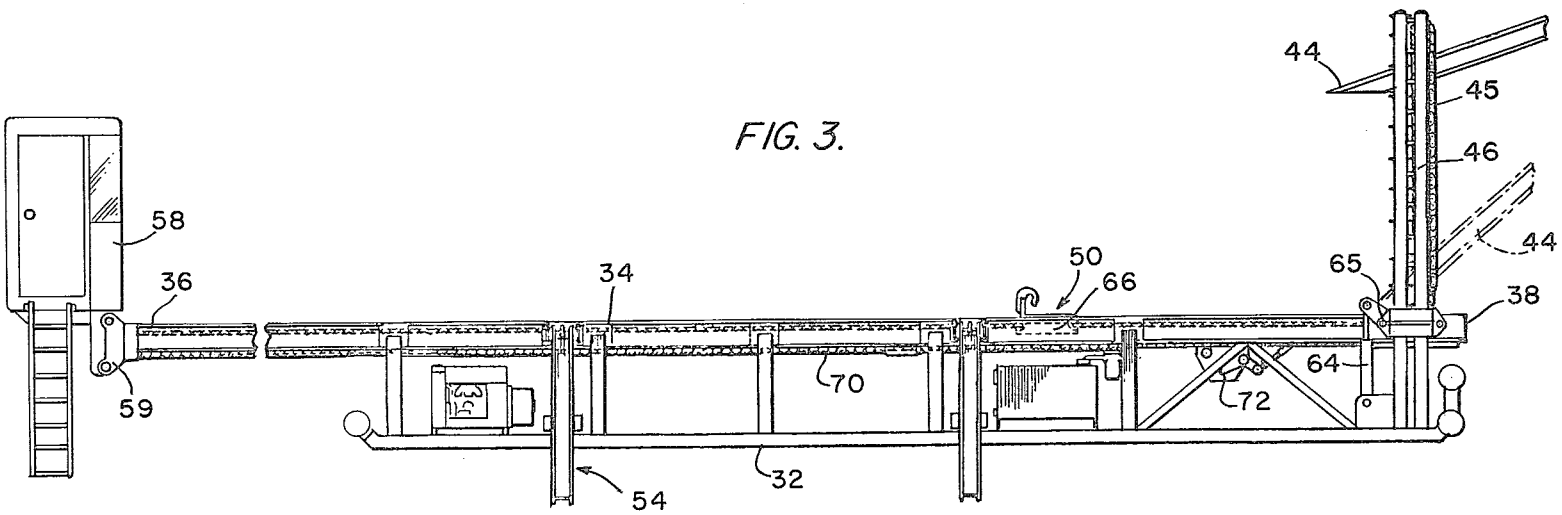
FIG. 3 is a side elevational view of the stationary trough of FIG. 2; the forward end of the movable trough is shown in phantom lines in its lower position.

Only a single operator is needed to operate all of the aforementioned systems of apparatus 30. The present invention provides for a operator's station or cab 58 for that operator and an appropriate control panel disposed therein. Cab 58 is attached to stationary trough end 36. As best shown in FIG. 3, cab attachment 59 includes a pivoting means whereby cab 58 may be pivoted until it rest on stationary trough 34 for easier loading and transporting of apparatus 30.

Detailed Description

The mast drive system shown generally at 62 in FIG. 3 is illustrated and described in further detail in commonly-owned U.S. application Ser. No. 328,252, filed Dec. 7, 1981, and corresponding PCT application Ser. No. PCT/US 81/01552 filed Nov. 20, 1981, which disclosures are hereby incorporated in their entirety. Briefly, though, mast drive system 62 includes a chain 45 connected at one end to movable trough end 44 and at the other end to a hydraulic cylinder assembly, which in the preferred embodiment comprises two parallel hydraulic cylinders, positioned between and adjacent masts 46, 46. As the cylinders are pressurized, the chain lifts movable trough end 44. Also, masts, 46 46 may be rotated between a vertical position and a horizontal position generally resting on trough 34 by a hydraulic lift system shown generally at 64. System 64 causes masts 46, 46 to pivot at 65 in a manner indicated by the arrows and phantom lines of FIG. 1.

Figure 2:
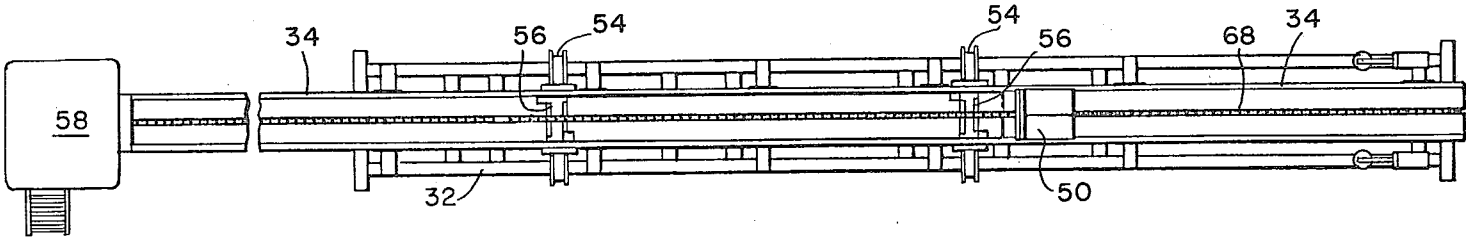
FIG. 2 is a top plan view of the stationary trough of FIG. 1.

Buggy 50 has a spine portion 66 depending therefrom and extending into slot 68 along the middle of stationary trough 34, as best shown in FIG. 2. Referring to FIG. 3, endless chain 70 is connected at opposite ends thereof to spine 66 and is powered to move buggy 50 along the stationary trough. A shock absorber mechanism 72 is employed along chain 70 to absorb some of the impact forces as pipe P moves from movable trough 40 to stationary trough 34.

Tilting arm assembly 56 is illustrated in FIGS. 4–10. Tilting arm assembly 56 comprises two sets of tilting arms 74 and each of these tilting arms 74 defines a wishbone shape, as well illustrated in FIG. 10. This wishbone shape includes arm portions 76 and 78 and hands 80 and 82. Hand surfaces 84 and 86 are shaped so that they lie flush with the surface of stationary trough 34 when the tilting arm is in the down or non-tilted position, as can seen in FIG. 4. The arm further includes holes 88 and 89 which provide pivotal connections.

Figure 6:
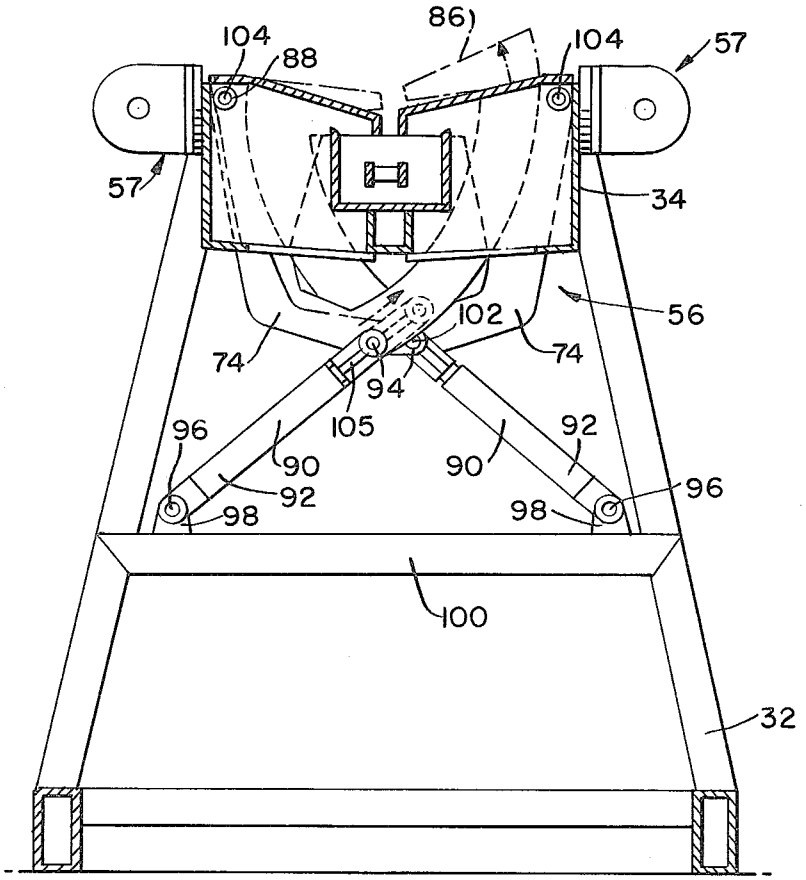
FIG. 6 is a side elevational view illustrating the tilting arms of FIG. 5; one tilting arm thereof is indicated in phantom lines in its raised or tilted position.
Figure 8:
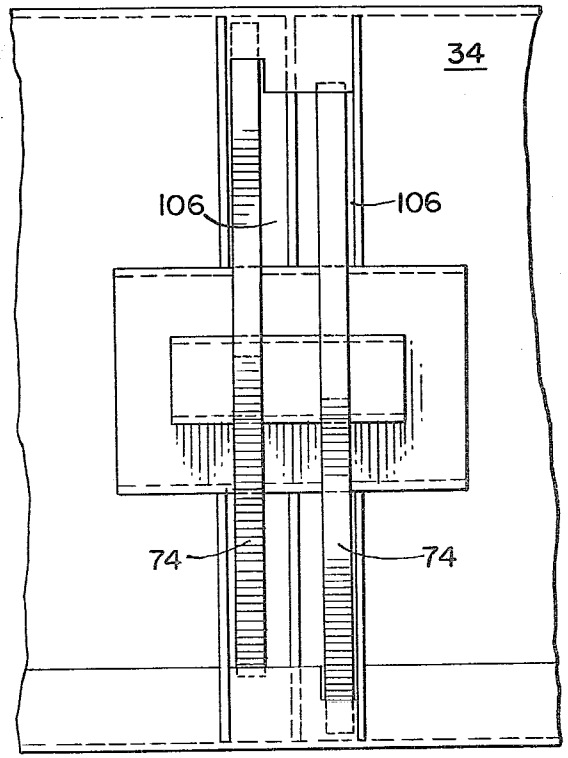
FIG. 8 is a bottom plan view of the stationary trough of FIG. 7.
Figure 7:
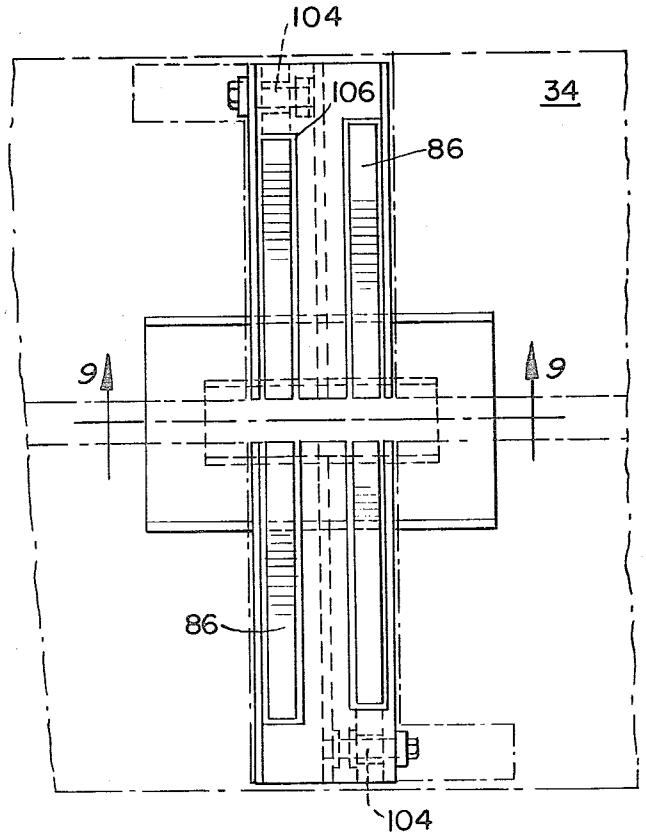
FIG. 7 is a top plan view of the stationary trough of FIG. 2 illustrating the tilting arms of FIGS. 5 and 6.
Figure 9:
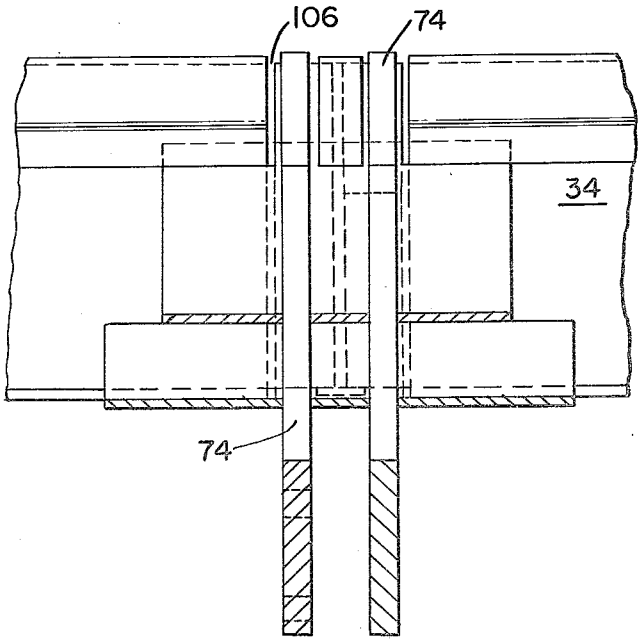
FIG. 9 is a cross-sectional view taken along line 9—9 of FIG. 7.
Figure 10:
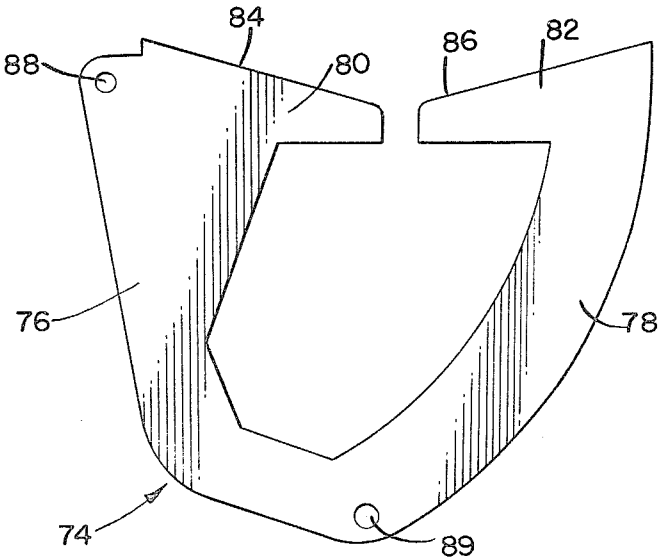
FIG. 10 is a side elevational view of one of the arm members of the tilting arms of FIG. 6, illustrated in isolation for clarity's sake.

As shown in FIG. 6, cylinder 90 is pivotally connected at each of its ends, lower end 92 and upper piston rod end 94. End 92 pivots about pin 96 which is mounted to ear 98. Ear 98 is securely mounted on cross member 100 of frame 32. End 94 pivots about pin 102 which passes through hole 89. Member 74, in addition to pivoting about pin 102, also pivots about pin 104. Pin 104 which passes through hole 88 is bolted to the stationary trough, as best shown in FIG. 6. Thus, as hydraulic cylinder 90 is pressurized by hydraulic fluid, its piston rod 105 extends arm 74 upward and thereby pivots it about pin 104. As it pivots, it extends through opening 106 (best shown in FIG. 4) in stationary trough 34 with surface 86 contacting a length of pipe P held therein and lifting it out of the stationary trough and rolling it towards the pipe rack R. Each set of arms is spaced a distance less then the length of a pipe and the hydraulic cylinders for them are pressurized at the same time so that the pipe is lifted in an even, horizontal manner.

Figure 11:
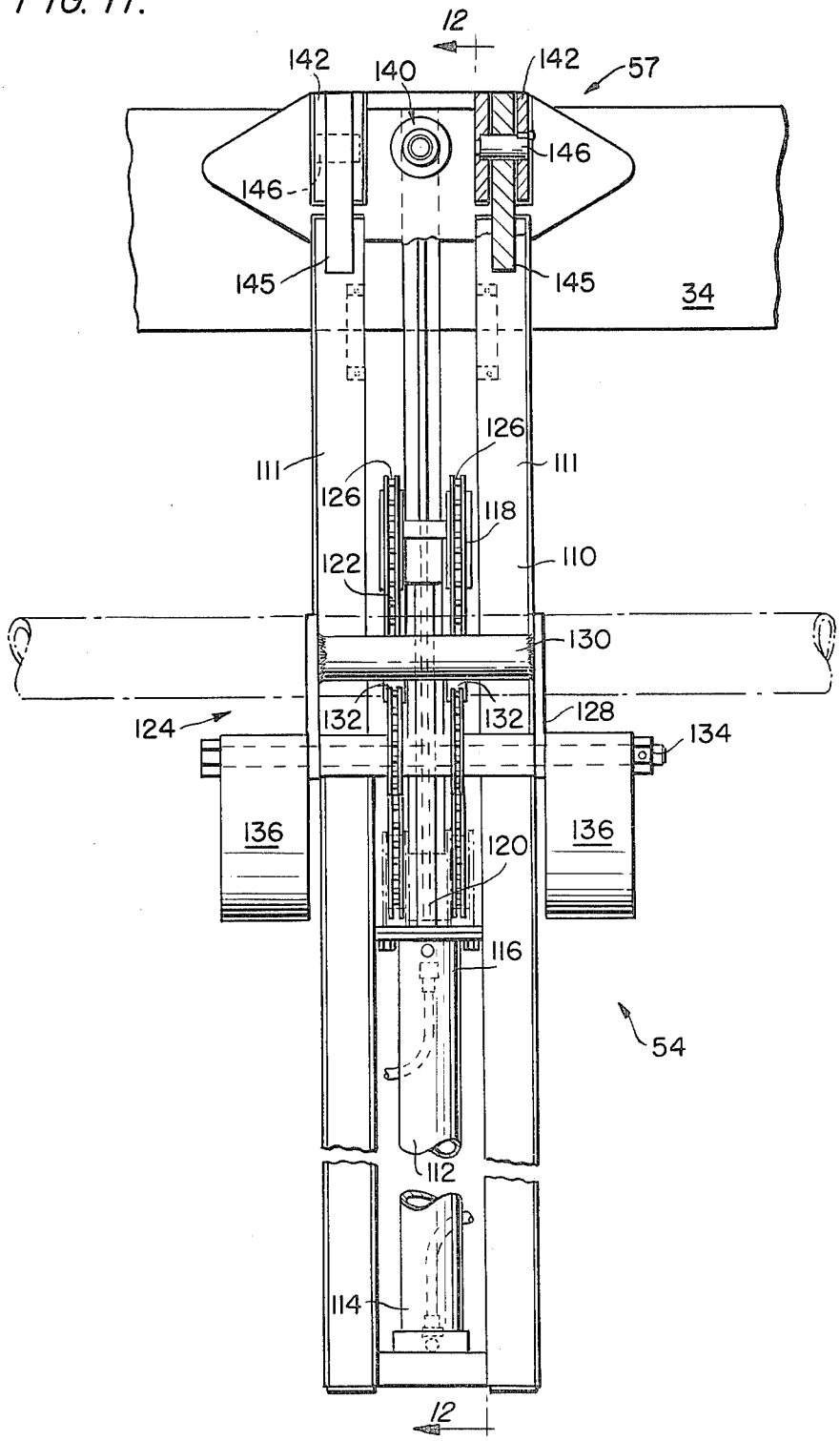
FIG. 11 is a fragmentary, partially broken away side elevational view of one of the racking arms of FIG. 1.
Figure 12:
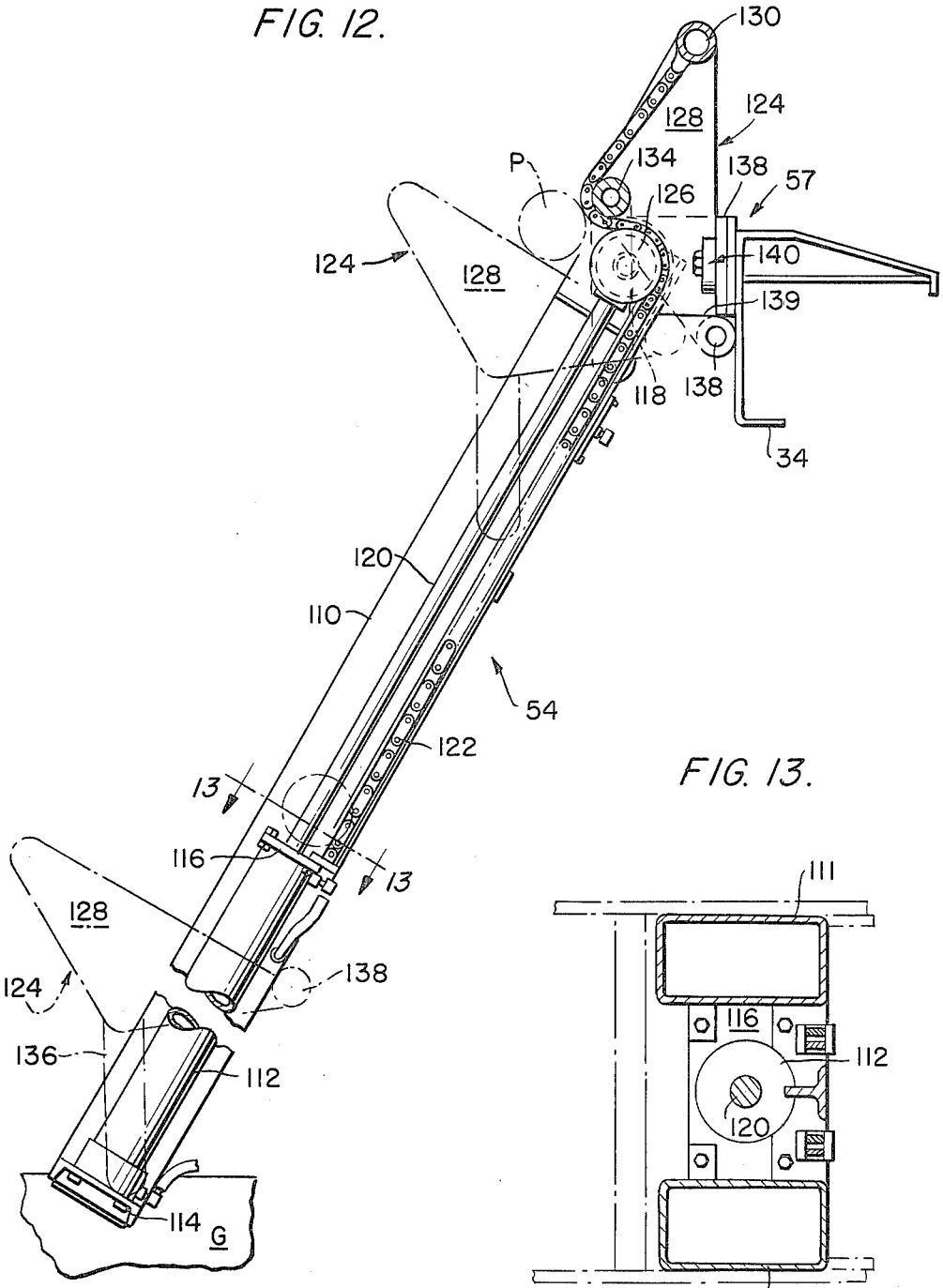
FIG. 12 is a cross-sectional view taken along line 12—12 of FIG. 11 wherein the movement of the cradling lug is illustrated in phantom lines.
Figure 13:
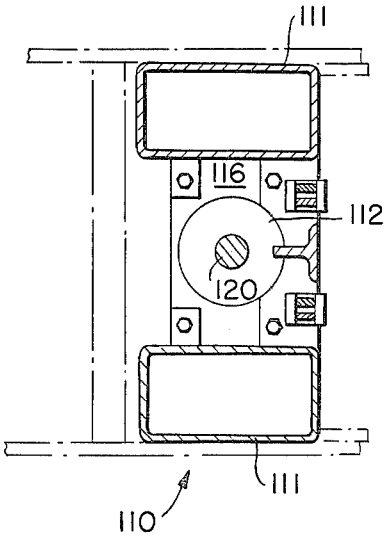
FIG. 13 is a cross-sectional view of the racking arm of FIG. 12 taken along line 13—13 of FIG. 12.

Referring to FIGS. 12 and 13, racking assembly 54 is shown. It basically comprises an arm 110, pivotally attached at its upper end to stationary trough 34 by pivotal attachment 57 and resting at its lower end on the ground, or similar surface, G. A hydraulic cylinder 112 is mounted in arm 110, which includes two interconnected box structures 111, 111, at its ends 114 and 116. A racking arm cross-head assembly 118 is attached at the end of piston rod 120 of hydraulic cylinder 112. A leaf chain 122 is attached at one end adjacent end 116 and at its other end to a lifting lug assembly shown generally at 124. It is lifting lug assembly 124 which cradles pipe P against arm 110 and, when pulled by leaf chain 122, lifts the pipe along the arm to stationary trough 134. Racking arm cross-head assembly 118 includes two parallel wheels 126, 126 which, when moved by piston 120, roll in arm 110 and about which leaf chain 122, 122 are reaved, as best shown in FIG. 11. Lifting lug assembly 124 includes two triangular shaped plates 128, 128, connected at one corner thereof by a roller tube 130. Roller tube 130 has welded thereto a pair of leaf chained clevise assemblies 132, 132 to which leaf chains 122, 122 are attached. A roller shaft 134 also interconnects plates 128, 128 at a second corner thereof. Rotatably secured to shaft 134 at either ends thereof and outside of plates 128, 128 are two weight members 136, 136 which are pivotally attached thereto and depending therefrom providing the needed weight to keep leaf chain 122 taut at all times. At the third corner of triangular plates 128, 128, a cam follower 138 is rotatably attached. As best shown in FIG. 12, and as lifting lug assembly is moved to the upper end of arm 110, cam follower 138 is cammed against surface 139 towards stationary trough 134 thereby causing a lifting lug assembly 124 to tilt towards stationary trough 34 and dumping pipe P into the trough. As hydraulic cylinder 112 is depressurized and piston 120 accordingly retracted, lifting lug assembly 124 aided by weight members 136, 136 is dropped down along the arm 110 past end 116 to ground G. Leaf chain 122 thus follows a path from point 116 down to point 114 and this allows for a racking arm assembly that does not require the piston to extend the full length of the arm member.

Referring to FIG. 1, it is seen that on either side of stationary trough 134 there are two racking arm assemblies 54, 54 on either side thereof. Each of the assemblies on one side of the stationary trough, or in the preferred embodiment on both sides of the stationary trough, are of identical construction and the hydraulic cylinders therefore are pressurized in parallel and identical manners so that the lifting lug assemblies travel up the respective arms at identical rates and the pipe moves in a level, horizontal manner. However, the racking arms assemblies on either side of the stationary trough are designed to operate independently of each other. Further, when the cradling lugs on one side of the stationary trough are dumping pipe into the trough, the cradling lugs on the other side can be in their upper position. This provides a safety stop so that when pipe is dumped into one side of the trough by the cradling lugs, it does not roll out the other side.

Figure 4:
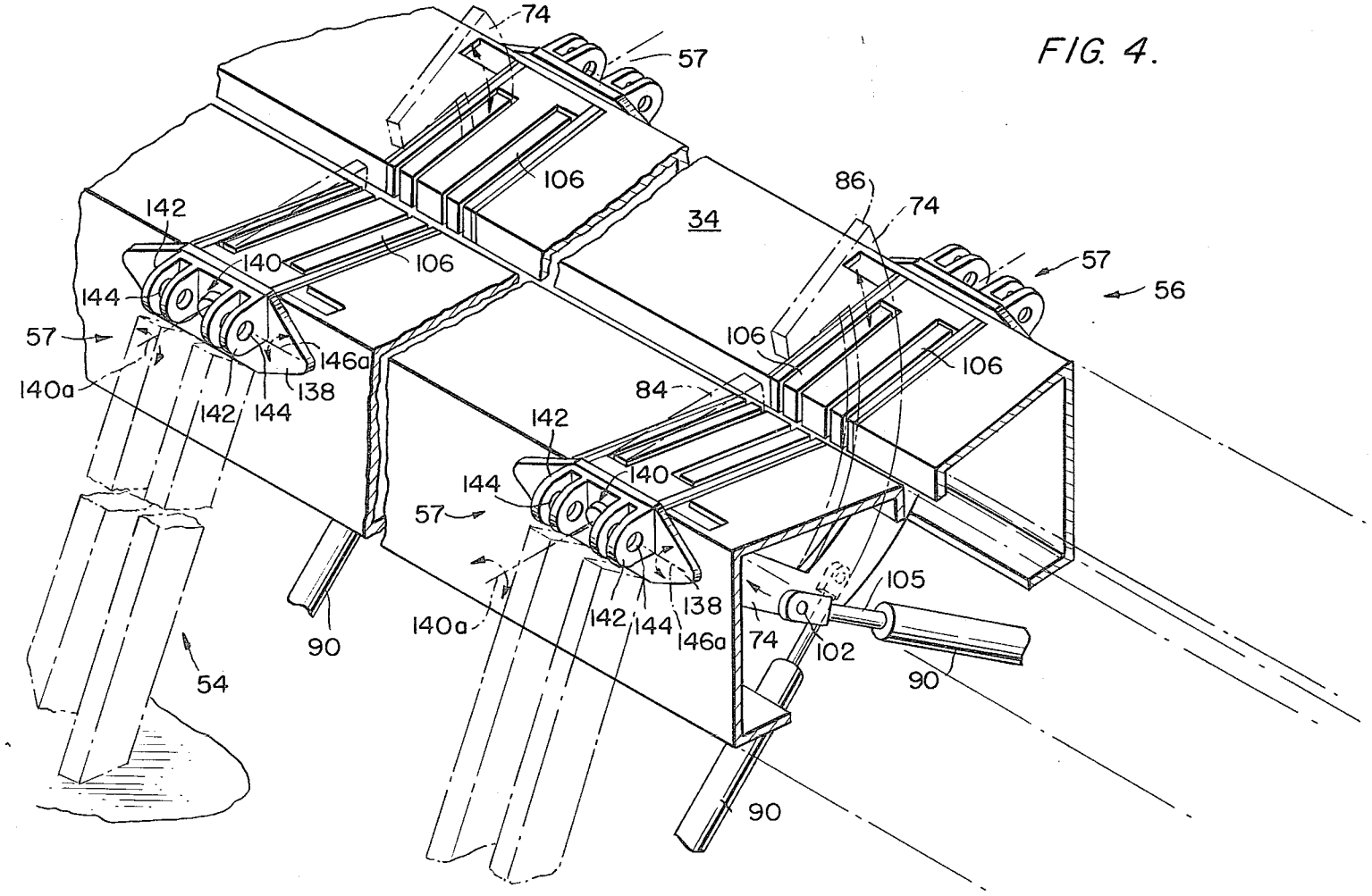
FIG. 4 is a fragmentary, perspective view of the tilting arms of the stationary trough or FIG. 1; one pair of tilting arms is shown in phantom lines in its raised or tilted position and the racking arms are shown in phantom lines in their down position.
Figure 5:
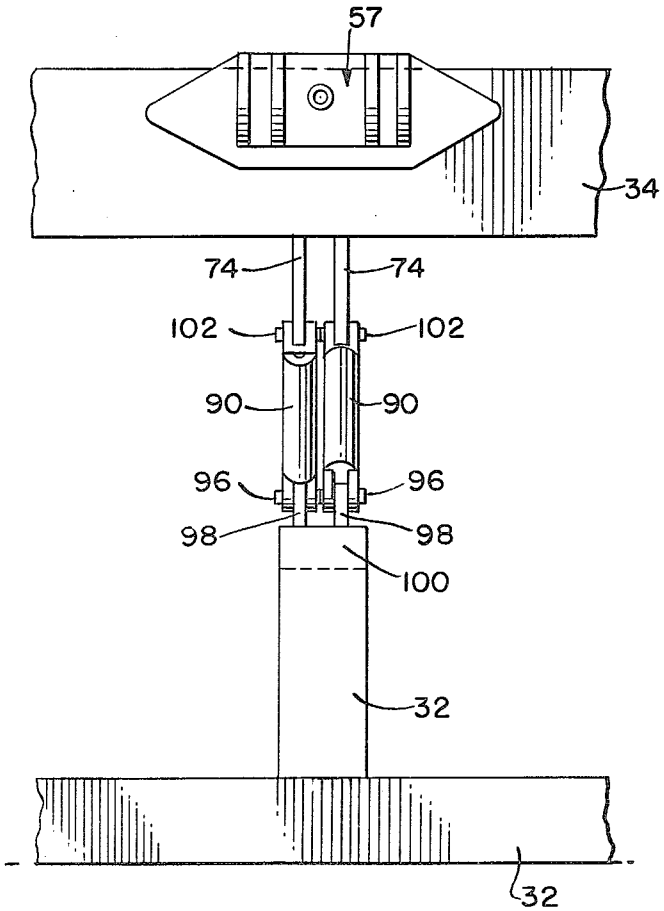
FIG. 5 is a fragmentary, side elevational view of the tilting arms of FIGS. 1 and 4.

As previously mentioned, pivotal attachment 57 for the racking arm assembly allows for pivotal movement of arm 110 about two axes, as best shown in FIG. 4. Pivotal attachment 57 includes a plate member 138 attached to the side of the stationary trough 34 by pivot assembly 140 which allows pivotal movement about axes **140*a* as shown in FIG. 4. Plate 138 further comprises two pair of ear members 142, 142 each having holes 144, 144** passing therethrough. Each pair of ears 142, 142 are spaced defining a slot therethrough in which tabs 145, 145 of structures 111, 111 can be placed. Tabs 145, 145 also have holes alignable with the holes in ears 142, 142 and through which pivot pins 146, 146 are positioned. Arm 110 is able to pivot about pins 146, 146, that is, about axis 146*a*. Arm 110, thus, may be moved between a down position resting on the ground and a horizontal, or stored, position against the stationary trough.

Figure 19:
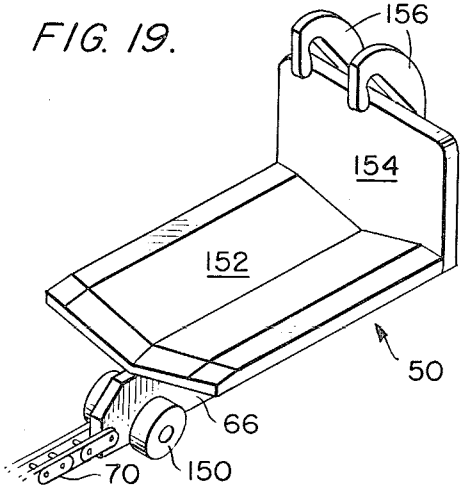
FIG. 19 is a perspective view of the carriage of FIGS. 1 and 14.

As shown in FIG. 19, buggy 50 has a spine portion 66 depending therefrom which passes through the slot in stationary trough 34. On opposing sides of spine portion 66 and at either ends thereof are two sets of rotatably mounted wheel assemblies 150. Wheel assemblies 150 are adapted to ride in channel 151 extending the length of and beneath stationary trough 34. Thus, the endless chain mounted at either end of the spine pulls buggy 50 which then rolls on its wheel assemblies 150, 150. Buggy 50 also has a horizontal member 152 which has a bottom contour similar to that of the stationary trough. At the rear edge of member 152 and mounted perpendicular thereto is a vertical member 154 and mounted on the back side of member 154 are two hooks 156, 156 having their hook portion extending over the top of member 154. It is hooks 156, 156 which engage shovel member 52.

Figure 14:
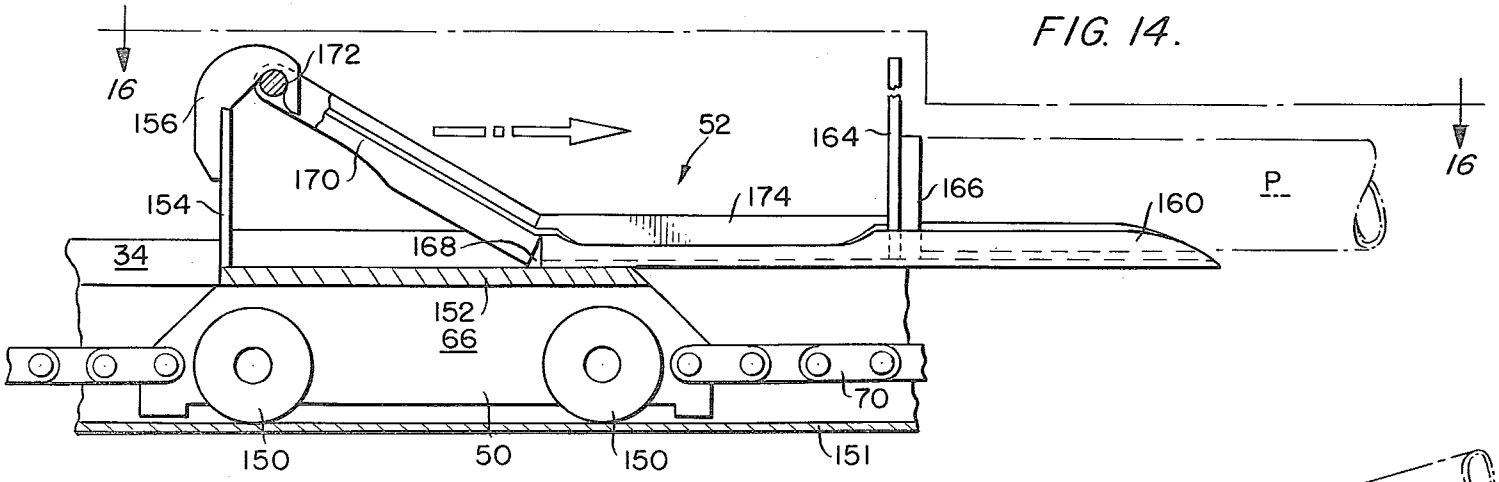
FIG. 14 is a side elevational view of the buggy in the stationary trough of FIG. 1 illustrating the movement thereof as it pushes a pipe along the stationary trough.
Figure 15:
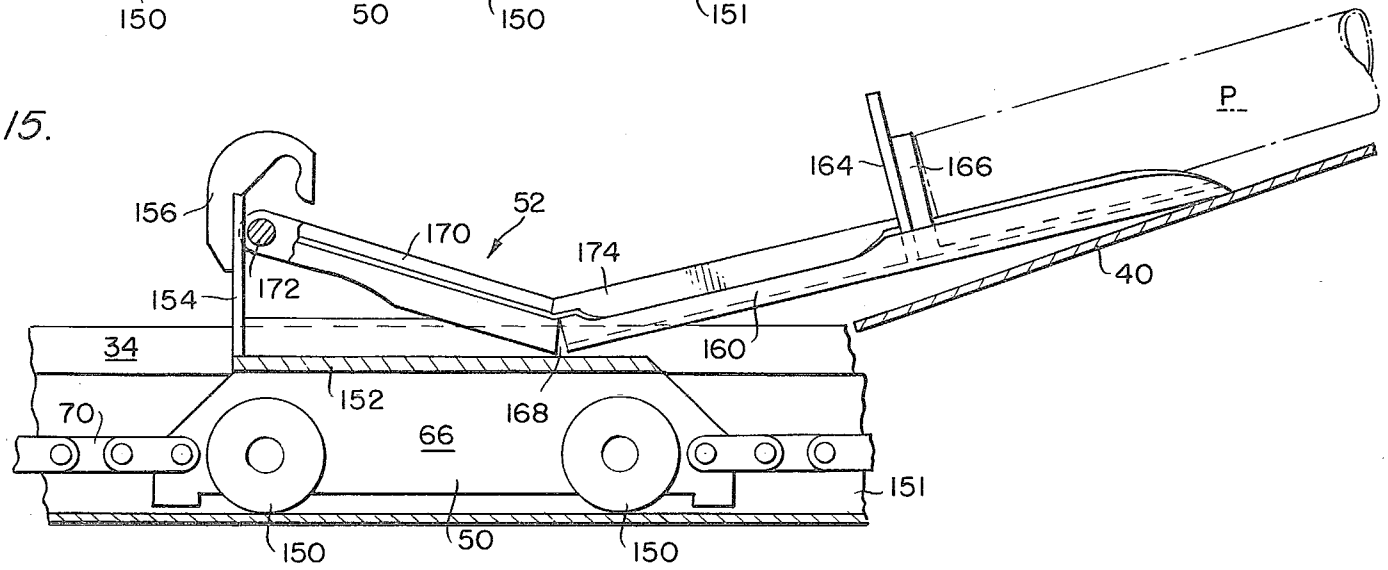
FIG. 15 is a view similar to that of FIG. 14 further illustrating the pipe-holding shovel assembly thereof as it engages and rides up the movable trough.
Figure 16:
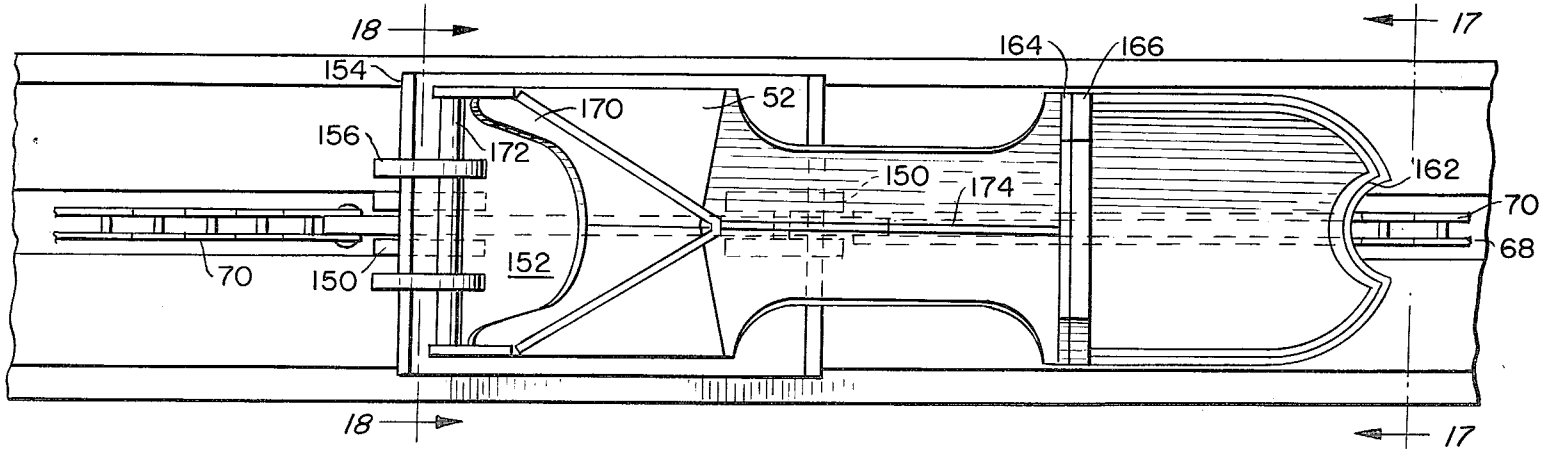
FIG. 16 is a top plan view taken along line 16—16 of FIG. 14.
Figure 18:
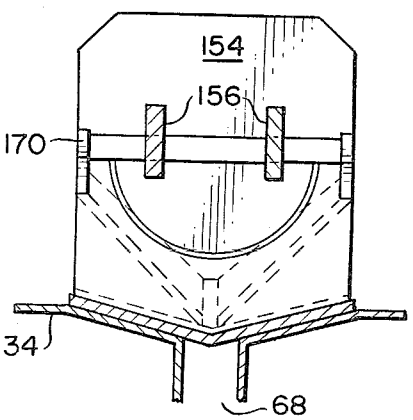
FIG. 18 is a cross-sectional view taken along line 18—18 of FIG. 16.
Figure 17:
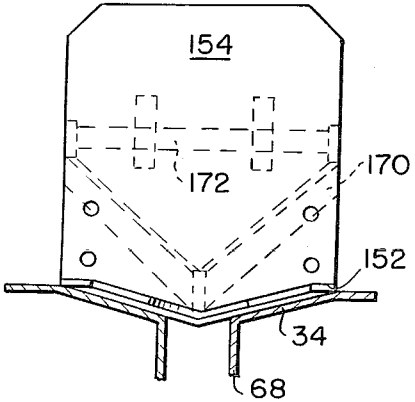
FIG. 17 is a cross-sectional view taken along line 17—17 of FIG. 16.
Figure 20:
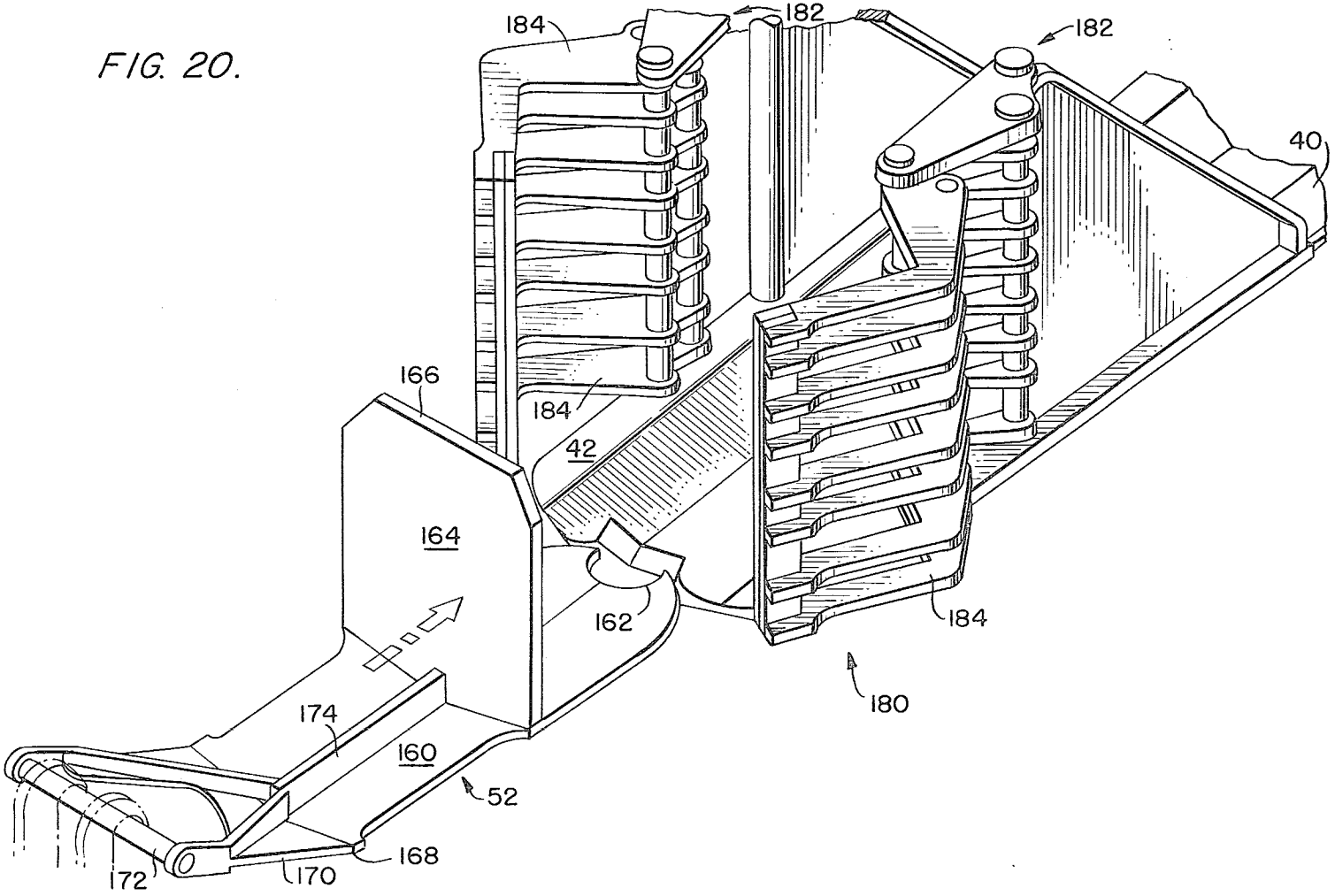
FIG. 20 is a fragmentary, perspective view of one embodiment of the present invention illustrating the shovel member as it moves onto the lower end of the movable trough of FIG. 1 when in its lower position; the arm members are shown in their open position.

As best shown in FIG. 20, shovel member 52 has a horizontal base member 160 contoured so that it can freely slide in stationary trough 34 and in movable trough 40. The forward tip of member 160 has, as best shown in FIG. 16, a beveled cutout 162 at the location that would be exposed to the greatest impact or damaging contact forces. Mounted vertically in a central section of member 160 is a striker plate 164. A resilient material or coating 166 is added to the forward face of plate 164. Coating 166 is added to provide a resilient surface against which pipe P can impact thereby absorbing some of the impact forces as well as preventing damage to the pin end of pipe P. Attached to the rear edge 168 of member 160 and at a angle to the horizontal arm members 170, 170, is a bar 172, which is mounted between arms 170, 170 at their uppermost ends. It is bar 172 which can be held by hooks 156, 156 of buggy 50 when shovel member 52 is moved by buggy 50. Shovel member 52 further includes a vertical spine 174 mounted in the center of plate 160 between plate 164 and arms 170. Spine 174 provides needed structural support. Thus, as shovel member 52 is moved by buggy 50, bar 172 is held by hooks 156, as shown in FIG. 14. Referring now to FIG. 15, it is seen that as buggy 50 pushes shovel member 53 and thus pipe P up movable trough end 44, shovel member 53 rotates about edge 168 thereby rotating bar 172 down and out of engagement with hooks 156 so that it can move up the movable trough. The present invention teaches two methods for holding shovel member 53 and moving it along movable trough 40.

Figure 21:
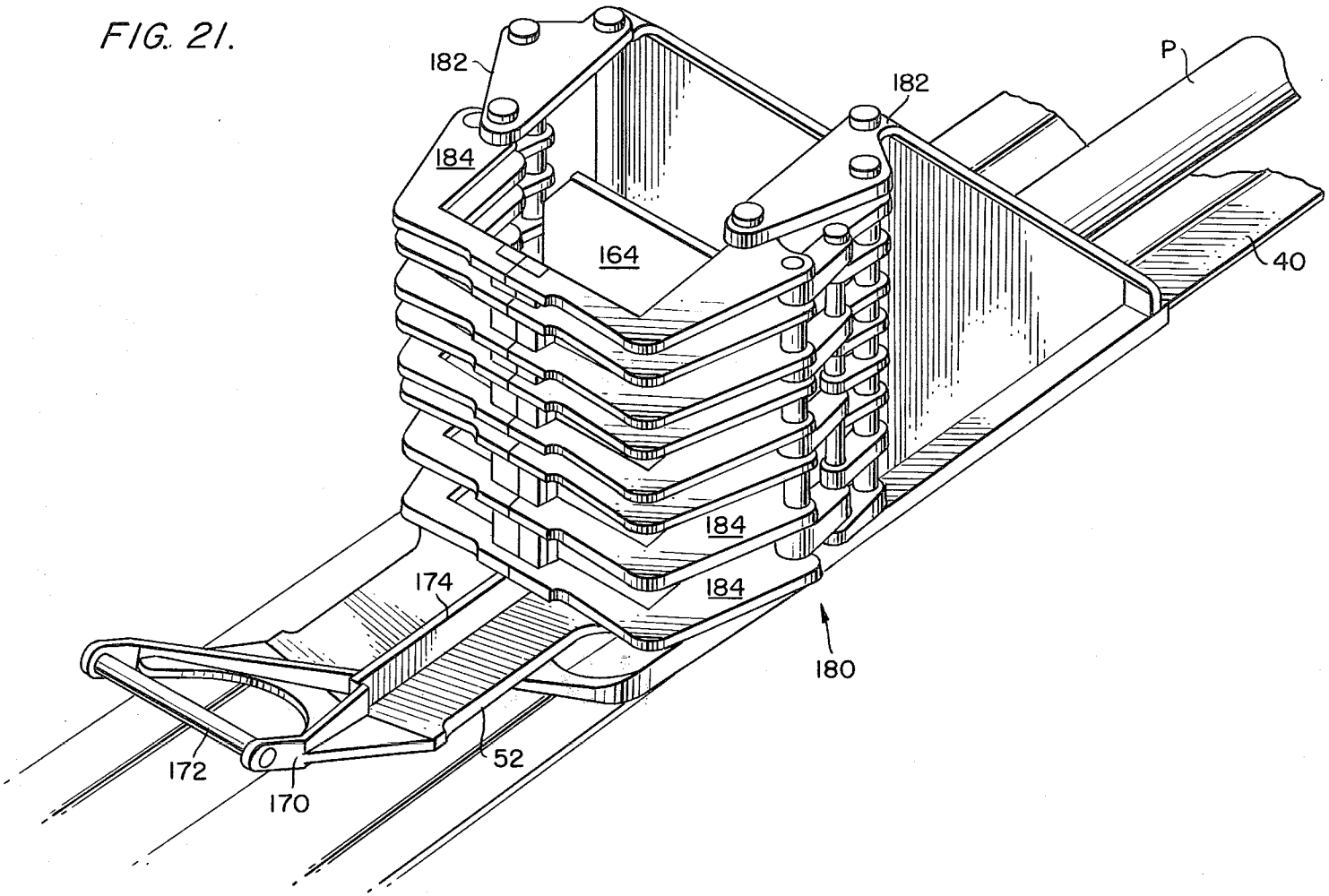
FIG. 21 is a perspective view similar to that of FIG. 20 illustrating the arms in their closed position as they move a length of pipe resting in the movable trough along that trough.

One method is illustrated in FIGS. 20 and 21 and includes a bucket assembly shown generally at 180. Greater detail and explanation for the operation of one suitable bucket assembly 180 is found in the previously incorporated applications. Briefly, though, it includes a chain drive (not shown herein), which pulls mast structure 182, 182. A plurality of arm segments 184, 184 are attached to mast structure 182. Bucket assembly 180 further includes a mechanism (not illustrated herein) for closing and opening arm segments 184 when bucket 180 is adjacent movable trough end 44. This mechanism provides a camming action which closes arm segments 184 as bucket assembly 180 is pulled by the chain drive away from end 44, and also opens the arms as the bucket assembly approaches end 44. Arm segments 184 close around plate 164 holding shovel member 53 therein for travel along movable trough 40.

Figure 22:
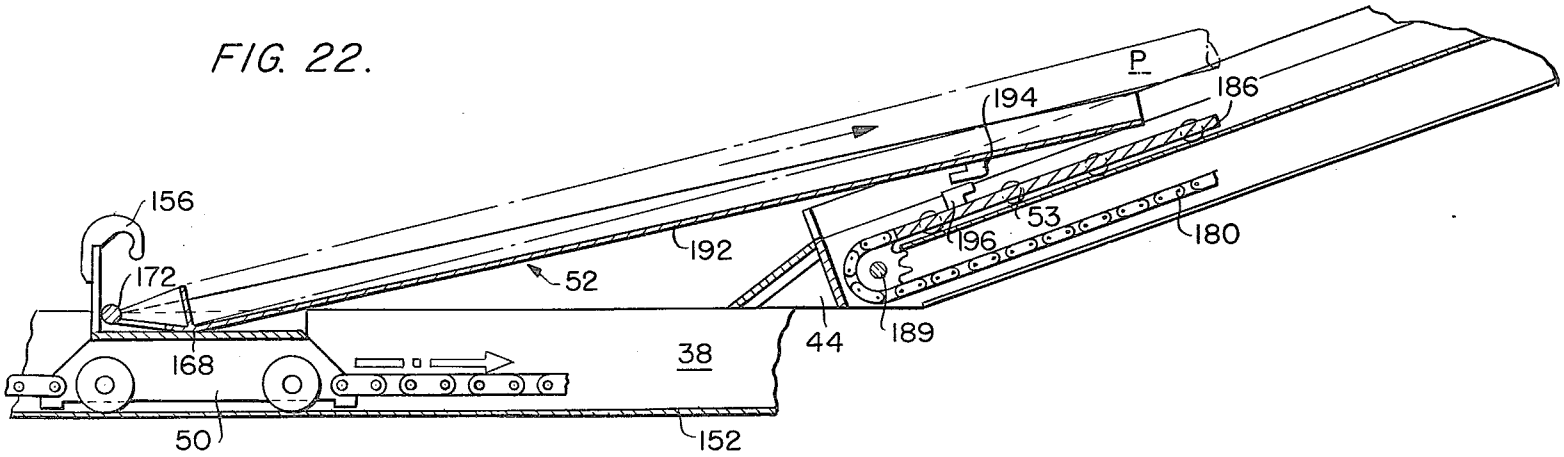
FIG. 22 is a side cross-sectional view of another embodiment of the present invention illustrating the lower end of the movable trough in its lower position.
Figure 23:
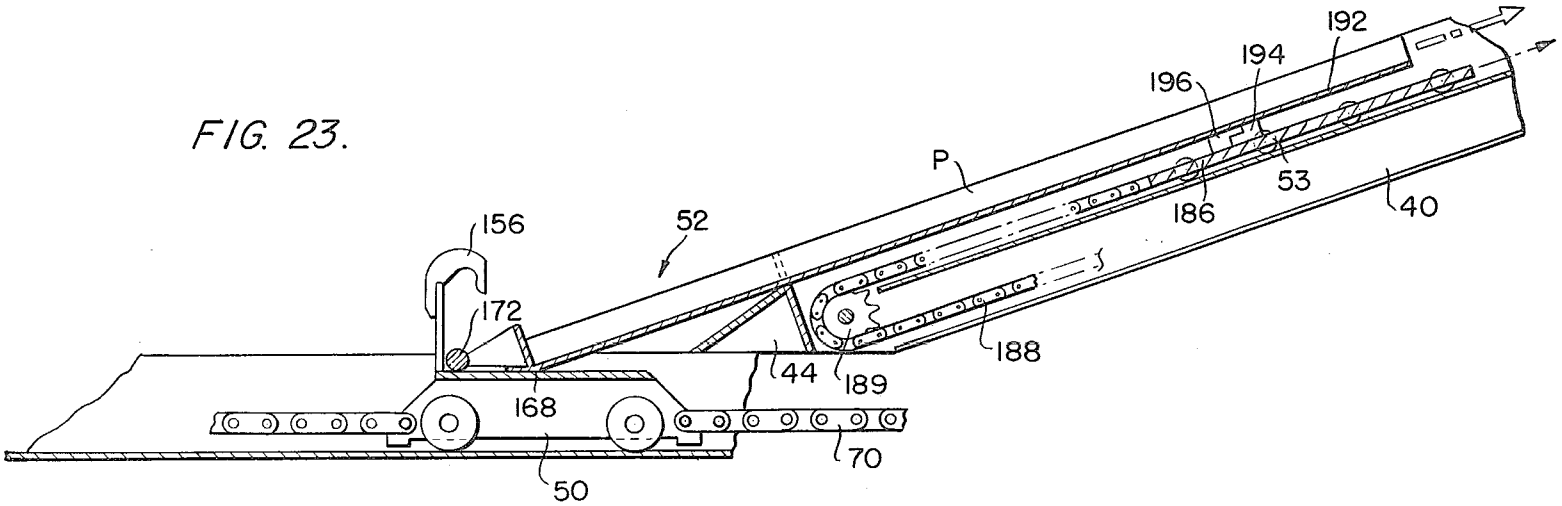
FIG. 23 is a view similar to that of FIG. 22 wherein the shovel member has engaged the carriage of the movable trough.

The second embodiment is shown FIGS. 22 and 23. It provides for a carriage 186 driven by continuous chain 188, which reeves about drive sprocket 189, along the length of movable trough 40. This embodiment further includes a slightly modified shovel member 190 having a longer forward plate member 192 and also having a first latch portion 194 depending therefrom at a forward location of plate 192. First latch portion 194 is adapted to engage a second mated latch portion 196 mounted on carriage 186. As shown in FIG. 23, these two latch portions engage as shovel member 53 is moved onto movable trough 40 and carriage 186 is pulled by chain 188 up movable trough 40. This latching and unlatching procedure is activated by the aforementioned rotating action of the shovel member about its edge 168 as it moves between the two troughs.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

We claim:

1. An apparatus for transferring pipe to and from the floor of a drilling rig comprising:

a stationary trough means for receiving and supporting pipe adapted to be located below the level of the floor of the drilling rig with one end extending toward said rig and located in proximity to said rig, a support means located at said one end of said stationary trough means, a movable trough means for receiving and supporting pipe aligned with said stationary trough means and having a first end coupled to said support means for generally vertical movement between a lower position and an upper position and having an opposite end adjacent said rig, said lower position being adjacent to said one end of said stationary trough means to permit the transfer of pipe between said movable and said stationary trough means, and said upper position being generally above and substantially spaced from said one end of said stationary trough means, a power means at said support means for moving said first end of said movable trough means between said lower and upper positions, a first moving means for moving pipe lengthwise along said stationary trough means to said one end and onto said movable trough means when said first end of said movable trough means is in said lower position and for allowing pipe to move down from said movable trough means when said movable trough means is in said lower position and into and along said stationary trough means, a second moving means for moving pipe lengthwise along said movable trough means between said first end when said movable trough means is in said lower position and said second end when in said upper position, and a holding means for holding pipe as it is moved by said first and second moving means and transferred between said first and second moving means.

2. The apparatus according to claim 1 further comprising:

a first connecting means for connecting said holding means and said first moving means as pipe is being moved lengthwise in said stationary trough means.

3. The apparatus according to claims 1 or 2 further comprising:

a second connecting means for connecting said holding means and said second moving means as pipe is being moved lengthwise in said movable trough means.

4. The apparatus according to claim 2 wherein:

said first connecting means disconnects said holding means and said holding means as said holding means moves from said stationary trough means to said movable trough means.

5. The apparatus according to claim 3 wherein:

said second connecting means disconnects said holding means and said second holding means as said holding means moves from said movable trough means to said stationary trough means.

6. The apparatus according to claim 1 further comprising:

a first connecting means for connecting said holding means and said first moving means as pipe is moved lengthwise in said stationary trough means, said first connecting means disconnects said holding means and said first moving means as said holding means moves from said stationary trough means to said movable trough means, and a second connecting means for connecting said holding means and said second moving means as pipe is moved lengthwise in said movable trough means, said second connecting means disconnects said holding means and said second connecting means as said holding means moves from said movable trough means to said stationary trough means, whereby said holding means holds pipe continuously as said pipe moves between the end of said stationary trough means opposite said one end and said second end of said movable trough means.

7. The apparatus according to claim 6 wherein:

said first connecting means comprises a hook means attached to said first moving means and a bar means attached to said holding means, said bar means being engageable in said hook means.

8. The apparatus according to claims 6 or 7 wherein:

said second connecting means includes a protruding member attached to said holding means, an arm means attached to said second moving means, and control means connected to said second moving means for closing said arm means about said protruding member after pipe has been moved from said stationary trough means to said movable trough means and for opening said arm means so that pipe can move between said stationary and movable trough means.

9. The apparatus according to claim 8 wherein:

said protruding member comprises vertical pipe support structure of said holding means.

10. The apparatus according to claim 9 wherein:

said protruding member includes a resilient material on the surface thereof which the pipe contacts.

11. The apparatus according to claim 8 wherein:

said control means is actuated as said second moving means approaches and leaves said first end of said movable trough means.

12. The apparatus according to claims 6 or 7 wherein:

said second connecting means comprises a latching mechanism including a first latch portion attached to said handling means and a second latch portion attached to said second moving means.

13. The apparatus according to claim 7 wherein:

said holding means pivots as it moves between said stationary trough means and said movable trough means, the intersection of said trough means defining an obtuse angle, and said pivoting action causes said bar to disengage from said hook as said holding means moves onto said movable trough means and to engage said hook as said holding means moves onto said stationary trough means.

14. The apparatus according to claim 12 wherein:

said holding means pivots as it moves between said stationary trough means and said movable trough means and said pivoting causes said first latch portion and said second latch portion to latch as said holding means moves onto said movable trough means and to unlatch as said holding means moves onto said stationary trough means.

15. An apparatus for transferring pipe between a pipe trough and one or more pipe racks positioned adjacent at least one side of the trough comprising:

a pipe trough, an arm connected at one end to said trough and having an opposite end positioned below said one end, a pipe cradling means for cradling pipe as the pipe is moved along said arm toward and away from said trough, a fluid actuated cylinder means associated with said arm for moving said cradling means long said arm when said cylinder means is pressurized, a connecting means operatively connecting said cylinder means to said cradling means, tilting means for tilting said cradling means towards said trough when said cradling means is positioned at said one end of said arm whereby pipe may be rolled from said cradling means to said trough, and a reeving means connected to said cradling means, said connecting means comprising a chain means attached at one end at a fixed point fixed relative to said arm and at a second end to said cradling means at an attachment point, said chain means, between said fixed point and said attachment point, reeving about said reeving means and about the piston of said cylinder means such that said cradling means moves along said arm as said cylinder means is pressurized.

16. The apparatus for transferring pipe according to claim 15 including, said attachment point being continually positioned above said reeving means as said cradling means moves along said arm.

17. The apparatus for transferring pipe according to claim 15 including, said fixed point being fixed to said cylinder means.

18. The apparatus for transferring pipe according to claim 15 including, said tilting means including a camming means connected to said cradling means and a cam surface associated with said one end of said arm, and said camming means following said cam surface as said cradling means is moved relative to said one end of said arm thereby tilting said cradling means.

19. The apparatus for transferring pipe according to claim 18 including, said arm having an upper side along which said pipe cradling means moves and an opposite lower side, and said cam surface being adjacent said lower side.

20. The apparatus for transferring pipe according to claim 19 including, a lug means attached to said cradling means for weighting said cradling means and thereby keeping said chain means taut.

21. The apparatus for transferring pipe according to claim 20 including, said lug means being attached to said cradling means at a location adjacent to said reeving means.

22. An apparatus for transferring pipe between a pipe trough and one or more pipe racks positioned adjacent said trough comprising:

a pipe trough, an arm connected at one end to said pipe trough, a moving means for moving pipe along the length of said arm, a connecting means for connecting the upper end of said arm to one side of said pipe trough, said connecting means providing for pivotal movement of said arm about a generally horizontal first axis parallel to the longitudinal axis of said pipe trough and about a horizontal second axis perpendicular to said first axis, said connecting means including a plate rotatable about said second axis, and an ear means mounted to said plate and supporting a member that includes said first axis, said ear means comprisng a first pair of ears and a second pair of ears, and said member comprising a first stub rod held by said first pair of ears and a second stub rod held by said second pair of ears.

23. The apparatus for transferring pipe according to claim 22 including, said plate being positioned ajacent said one side of said pipe trough, and said arm being supported by said member.

24. An apparatus for transferring pipe to and from the floor of a drilling rig comprising:

a horizontal stationary trough means for receiving and supporting pipe adapted to be located below the level of said drilling rig floor with one end extending toward said rig and located in proximity to said rig, and an opposite second end, a support means located at said one end of said stationary trough means, a movable trough means for receiving and supporting pipe aligned with said stationary trough means and having a first end coupled to said support means for generally vertical movement between a lower position and an upper position and having an opposite end adjacent said rig, said lower position being adjacent to said one end of said stationary trough means to permit the transfer of pipe between said movable and said stationary trough means, said upper position being generally above and substantially spaced from said one end of said stationary trough means, a first moving means for moving pipe lengthwise along said stationary trough means to said one end and onto said movable trough means when said first end of said movable trough means is in said lower position and for allowing pipe to move down from said movable trough means when said movable trough means is in said lower position and into and along said stationary trough means, a power means at said support means for moving said first end of said movable trough means between said lower and upper positions, a transferring means for transferring pipe from said movable trough means when in said upper position to said drilling rig floor, an operator's station disposed at said opposite second end, a housing enclosing said operator's station and disposed perpendicular to said stationary trough means, said housing including a viewing arrangement positioned so that an operator positioned in said housing views said stationary trough means and said movable trough means, said housing further including an access means to and from the interior of said housing, a pivotal attaching means for pivotally attaching said housing to said stationary trough means opposite second end such that said housing can pivot to a transport position resting generally on said stationary trough means, and said pivotal attaching means including a pivot axis positioned behind and generally above said opposite second end.

25. An apparatus for moving pipe laterally in and out of a trough comprising:

a frame, a trough, which is adapted to receive and support a length of pipe, supported on said frame, said trough providing a surface along which said pipe can move lengthwise, an arm means positioned laterally beneath said surface, said arm means defining a wishbone having a first arm segment, a first hand connected to said first arm segmemt and positioned to engage the pipe positioned in said trough, a second arm segment connected to said first arm segment, and a second hand connected to said second arm segment and positioned to engage the pipe positioned in said trough, said first arm segment being pivotally connected to said trough, a cylinder means having a lower end pivotally attached to said frame beneath said first arm segment and an upper end pivotally attached to a lower central point of said arm means, said arm means pivoting when said cylinder means is pressurized and raising said second hand through an opening in said trough surface thereby engaging a pipe positioned therein and forcing the pipe laterally out of said trough, and said second hand being positioned beneath said surface when said cylinder means is not pressurized whereby pipe positioned in said trough does not contact said second hand and pipe can slide lengthwise in said trough.

26. The apparatus according to claim 25 including, said first hand and said second hand being spaced and defining a slot therebetween.

27. The apparatus according to claim 25 including, said cylinder means when in its unpressurized state being positioned at a 45 degree angle relative to the horizontal.

* * * * *